US011597892B2

(12) United States Patent
Nomura

(10) Patent No.: US 11,597,892 B2
(45) **Date of Patent: *Mar. 7, 2023**

(54) METHOD FOR WASHING HARD ARTICLE

(71) Applicant: Kao Corporation, Tokyo (JP)

(72) Inventor: Takayuki Nomura, Tokyo (JP)

(73) Assignee: Kao Corporation, Tokyo (JP)

( * ) Notice: Subject to any disclaimer, the term of this patent is extended or adjusted under 35 U.S.C. 154(b) by 490 days.

This patent is subject to a terminal disclaimer.

(21) Appl. No.: 16/630,766

(22) PCT Filed: Jul. 13, 2018

(86) PCT No.: PCT/JP2018/026480
§ 371 (c)(1),
(2) Date: Jan. 13, 2020

(87) PCT Pub. No.: WO2019/013322
PCT Pub. Date: Jan. 17, 2019

(65) Prior Publication Data

US 2021/0102144 A1 Apr. 8, 2021

(30) Foreign Application Priority Data

Jul. 14, 2017 (JP) ..... JP2017-138149

(51) Int. Cl.

| | |
|---|---|
| ***C11D 1/14*** | (2006.01) |
| ***C11D 1/90*** | (2006.01) |
| ***C11D 3/04*** | (2006.01) |
| ***C11D 3/30*** | (2006.01) |
| ***B08B 3/04*** | (2006.01) |
| ***B08B 3/08*** | (2006.01) |
| ***C11D 1/94*** | (2006.01) |
| ***C11D 11/00*** | (2006.01) |
| ***C11D 17/00*** | (2006.01) |
| *C11D 1/46* | (2006.01) |

(52) U.S. Cl.
CPC ..... *C11D 1/14* (2013.01); *B08B 3/08* (2013.01); *C11D 1/94* (2013.01); *C11D 3/046* (2013.01); *C11D 3/30* (2013.01); *C11D 11/0035* (2013.01); *C11D 17/0008* (2013.01); *C11D 1/46* (2013.01); *C11D 1/90* (2013.01)

(58) Field of Classification Search
CPC .. C11D 1/14; C11D 1/143; C11D 1/90; C11D 3/04; C11D 3/30; B08B 3/04; B08B 3/08
See application file for complete search history.

(56) References Cited

U.S. PATENT DOCUMENTS

| | | | | |
|---|---|---|---|---|
| 3,808,157 | A * | 4/1974 | De Witt et al. | C11D 1/143 510/237 |
| 3,860,528 | A | 1/1975 | DeWitt et al. | |
| 4,715,991 | A | 12/1987 | Hirakouchi et al. | |
| 5,078,916 | A * | 1/1992 | Kok | C11D 1/83 510/498 |
| 2014/0038876 | A1 | 2/2014 | Østergaard et al. | |
| 2014/0080751 | A1 | 3/2014 | Yoshikawa et al. | |
| 2015/3667751 | | 12/2015 | Yoshikawa et al. | |
| 2016/0332961 | A1 | 11/2016 | Hori et al. | |
| 2020/0231899 | A1* | 7/2020 | Sakuraba | C11D 1/143 |

FOREIGN PATENT DOCUMENTS

| | | | |
|---|---|---|---|
| CN | 104661637 | A | 5/2015 |
| CN | 104937088 | A | 9/2015 |
| CN | 105849085 | A | 8/2016 |
| JP | 61-247799 | A | 11/1986 |
| JP | 2005-206835 | A | 8/2005 |
| JP | 2014-506945 | A | 3/2014 |
| JP | 2015-28123 | A | 2/2015 |
| JP | 2015-42707 | A | 3/2015 |
| JP | 2016-35009 | A | 3/2016 |
| JP | 2016-147927 | A | 8/2016 |
| JP | 2016-147928 | A | 8/2016 |
| WO | WO-2004050811 | A1 | 6/2004 |

OTHER PUBLICATIONS

International Search Report (PCT/ISA/210) issued in PCT/JP2018/026480, dated Sep. 18, 2018.
Stapersma et al., "Hydroxy Alkane Sulfonate (HAS), a New Surfactant Based on Olefins," J. Am. Oil Chem. Soc., vol. 69, No. 1. Jan. 1992, pp. 39-43.
Taiwanese Office Action dated Jun. 24, 2021 in Patent Application No. 107124233 (with English translation of categories), 8 pages.
Extended European Search Report dated Jun. 14, 2021 in Patent Application No. 18832619.3, 6 pages.
International Preliminary Report on Patentability and English translation of the Written Opinion of the International Searching Authority, dated Jan. 23, 2020, far International Application No. PCT/JP2018/026480.

* cited by examiner

*Primary Examiner* — Brian P Mruk
(74) *Attorney, Agent, or Firm* — Element IP, PLC

(57) ABSTRACT

The present invention provides a method for washing a hard article, the method including: the contact step of bringing a detergent liquid obtained by mixing (a) a potassium internal olefin sulfonate and (b) water having a hardness of 5° DH or more, into contact with the hard article, and the step of rinsing the hard article after the contact step with water having a hardness of 5° DH or more, wherein the detergent liquid at 30° C. or more is brought into contact with the hard article in at least a part of the contact step.

14 Claims, No Drawings

METHOD FOR WASHING HARD ARTICLE

FIELD OF THE INVENTION

The present invention relates to a method for washing a hard article, and a detergent composition for a hard article.

BACKGROUND OF THE INVENTION

Anionic surfactants are excellent in detergency and foamability, and are widely used as a component of detergents. One known anionic surfactant is an internal olefin sulfonate obtained from, as a raw material, an internal olefin having a double bond not at an end of an olefin chain, but in an internal part thereof. Such an internal olefin sulfonate is obtained by, for example, reacting an internal olefin with a gaseous sulfur trioxide-containing gas to sulfonate the internal olefin, and neutralizing and then further hydrolyzing the resulting sulfonic acid. Such an internal olefin sulfonate is known to be favorable in biodegradability.

Use of an internal olefin sulfonate for washing an article such as tableware has been conventionally proposed.

U.S. Pat. No. 5,078,916 describes a detergent composition comprising an internal olefin sulfonate salt, having from 8 to 26 carbon atoms, wherein at least 25 percent by weight is in the beta-hydroxy alkane sulfonate form.

JP-A 2016-35009 describes a biofilm-removing composition for a hard surface, the composition containing 1% by mass or more and 40% by mass or less of an internal olefin sulfonate.

JP-A 2016-147928 describes a tableware-washing detergent composition for hand-washing, the composition containing: (a) an internal olefin sulfonate having 8 or more and 24 or less carbons; (b) a fatty acid having 8 or more and 22 or less carbons, or salt thereof; (c) one or more compounds selected from a specified alkanolamide (c1), specified fatty acid amide propyl betaine (c2) and specified polyoxyethylene alkyl or alkenyl amine (c3); in respective predetermined conditions, in which the mass ratio (c)/(a) is 0.01 or more and 1 or less.

JP-A 2016-147927 describes a tableware-washing detergent composition for hand-washing, the composition containing: (a) an internal olefin sulfonate having 8 or more and 24 or less carbons; (b) a fatty acid having 8 or more and 22 or less carbons, or a salt thereof; (c) an amine oxide having a hydrocarbon group with 8 or more and 22 or less carbons; and (d) a compound selected from an alkylsuccinic acid having an alkyl group with 8 or more and 22 or less carbons, an alkenylsuccinic acid having an alkenyl group with 8 or more and 22 or less carbons, and salts and anhydrides thereof; in respective predetermined conditions, in which the mass ratio (d)/(a) is 0.01 or more and 1 or less.

SUMMARY OF THE INVENTION

There are needs for a further enhancement in detergency and excellent rinsability in washing of a hard article such as tableware with an internal olefin sulfonate.

The present invention provides a method for washing a hard article with an internal olefin sulfonate, the washing method providing excellent detergency and rinsability.

The present invention relates to a method for washing a hard article, the method including: the contact step of bringing a detergent liquid obtained by mixing (a) a potassium internal olefin sulfonate and (b) water having a hardness of 5° DH or more, into contact with the hard article, and the step of rinsing the hard article after the contact step with water having a hardness of 5° DH or more, wherein the detergent liquid at 30° C. or more is brought into contact with the hard article in at least a part of the contact step.

The present invention also relates to a detergent composition for a hard article, wherein (a) a potassium internal olefin sulfonate and (b) water having a hardness of 5° DH or more are formulated.

The present invention encompasses a method for washing a tableware, the method including: the contact step of bringing a detergent liquid obtained by mixing (a) a potassium internal olefin sulfonate and (b) water having a hardness of 5° DH or more, into contact with the tableware, and the step of rinsing the tableware after the contact step with water having a hardness of 5° DH or more, wherein the detergent liquid at 40° C. or more is brought into contact with the tableware in at least a part of the contact step.

The present invention also encompasses a detergent composition for a tableware, wherein (a) a potassium internal olefin sulfonate and (b) water having a hardness of 5° DH or more are formulated.

Hereinafter, the description will be made with (a) a potassium internal olefin sulfonate, as component (a) and (b) water having a hardness of 5° DH or more, as component (b).

The present invention provides a method for washing a hard article such as tableware with an internal olefin sulfonate, the washing method providing excellent detergency and rinsability. The rinsability is usually determined by the degree of defoaming in rinsing.

EMBODIMENTS OF THE INVENTION

<Method for Washing Hard Article>

It has been found in the present invention that detergency and rinsability are remarkably enhanced by using a potassium ion as a counter ion of an internal olefin sulfonic acid in washing of a hard article such as tableware with an internal olefin sulfonate, and specifying the hardness and the temperature of water for use in washing in detail.

The potassium internal olefin sulfonate (hereinafter, sometimes referred to as "IOS-K") as component (a) in the present invention is a compound obtained by, for example, subjecting an internal olefin as a raw material to sulfonation, neutralization, and hydrolysis. The internal olefin herein is widely meant to also encompass those containing a trace of so-called α-olefin, in which a double bond is present at position 1 of a carbon chain. Such an internal olefin is sulfonated to thereby quantitatively generate β-sultone, such β-sultone is partially changed to γ-sultone and an olefin sulfonic acid, and such resultants are then further converted to hydroxyalkanesulfonate and olefin sulfonate in a neutralization/hydrolysis step (for example, J. Am. Oil Chem. Soc. 69, 39 (1992)). The hydroxyalkanesulfonate here obtained has a hydroxy group in an internal part of an alkane chain, and the olefin sulfonate has a double bond in an internal part of an olefin chain. The resulting product is mainly a mixture thereof, and may also partially contain a trace of a hydroxyalkanesulfonate having a hydroxy group at an end of a carbon chain, or a trace of an olefin sulfonate having a double bond at an end of a carbon chain. Such a product may also contain a trace of an olefin sulfonate in which the sulfonic acid group is present at position 1 of a carbon chain. Herein, each of these products and a mixture thereof are collectively referred to as "internal olefin sulfonate." The hydroxyalkanesulfonate is referred to as a hydroxy form of the internal olefin sulfonate, and the olefin sulfonate is referred to as an olefin form of the internal olefin sulfonate. Among such internal olefin sulfonates, a potassium internal olefin sulfonate is component (a) in the present invention.

In the present invention, the ratio of IOS-K having the sulfonic acid group at position 2 in component (a) is preferably 5% by mass or more, more preferably 6% by mass or more, and preferably 20% by mass or less, more preferably 18% by mass or less, in view of detergency. The content of IOS-K having the sulfonic acid group at position 2 in component (a) can be measured by a procedure such as a gas chromatography or a nuclear magnetic resonance spectrum.

In the present invention, the amount of IOS-K having the sulfonic acid group at position 1 of a carbon chain in component (a) is preferably small. In the present invention, the content of IOS-K having the sulfonic acid group at position 1 of a carbon chain (hereinafter, referred to as "component (a')") in component (a) is preferably 20% by mass or less. In the present invention, the content of component (a') in component (a) is preferably 20% by mass or less, more preferably 10% by mass or less, further preferably 5% by mass or less, furthermore preferably 3% by mass or less, in view of detergency and rinsability. The content of component (a') in component (a) can be 0% by mass or more, and may also be 0% by mass.

Component (a') may also be IOS-K having 8 or more and 24 or less carbons. Examples of the hydrocarbon group of component (a) and component (a') include an alkyl group and an alkenyl group, and a hydroxy group may be contained therein.

IOS-K having the sulfonic acid group at position 1 of a carbon chain, as component (a'), the content of which is desirably limited in the present invention, is a compound schematically represented by the following formula. Other compound as component (a) can be expressed as a compound in which the sulfonic acid group is bound to a carbon atom at a position other than position 1 of a carbon chain in the following formula. In the following formula, "—$SO_3K$" is a sulfonic acid group in the form of a potassium salt.

[Formula 1]

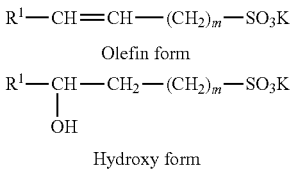

wherein $R^1$ represents an alkyl group, and m is an integer of 0 or more, preferably 1 or more.

Component (a) preferably has 8 or more and 24 or less carbons, more preferably 12 or more carbons, more preferably 16 or more carbons, and preferably 22 or less carbons, more preferably 20 or less carbons, more preferably 18 or less carbons, in view of detergency and rinsability.

Component (a) is preferably IOS-K having 16 or more and 18 or less carbons. Component (a) is more preferably IOS-K having 18 carbons. That is, the detergent liquid for use in the present invention preferably contains IOS-K having 16 or more and 18 or less carbons, as component (a). The detergent liquid for use in the present invention more preferably contains IOS-K having 18 carbons, as component (a).

The mass ratio of a potassium internal olefin sulfonate having 16 carbons (hereinafter, referred to as "$C_{16}$IOS-K") and a potassium internal olefin sulfonate having 18 carbons (hereinafter, referred to as "$C_{18}$IOS-K") in component (a), $C_{16}$IOS-K/$C_{18}$IOS-K, is preferably 0.1 or less, more preferably 0.05 or less, further preferably 0.01 or less, and preferably 0 or more, and may be 0.

In the present invention, the ratio of the total of $C_{16}$IOS-K and $C_{18}$IOS-K in component (a) is preferably 50% by mass or more, more preferably 70% by mass or more, further preferably 80% by mass or more, furthermore preferably 90% by mass or more, furthermore preferably 95% by mass or more, furthermore preferably 97% by mass or more, and preferably 100% by mass or less, and may also be 100% by mass, in view of detergent properties and rinsability.

The detergent liquid for use in the present invention preferably contains component (a) in an amount of 0.001% by mass or more, more preferably 0.01% by mass or more, further preferably 0.1% by mass or more, and preferably 30% by mass or less, more preferably 20% by mass or less, further preferably 10% by mass or less.

A detergent liquid obtained by mixing component (a) and water having a hardness of 5° DH or more as component (b) is used in the present invention, in view of detergency and rinsability. The hardness of component (b) can be selected from 5° DH or more, further 10° DH or more, and further 15° DH or more. The hardness of component (b) can also be selected from 30° DH or less, further 27° DH or less, and further 25° DH or less.

For the hardness of water (° DH), the concentration expressed in terms of $CaCO_3$ (mg/L) is determined according to "Chelate Titration Method" in 15.1.1 described in "Total Hardness" in 15.1 of Chapter 15 in JIS K 0101:1998 "Testing Methods for Industrial Water", and this concentration is converted into the hardness of water by the following expression.

$$\text{Hardness of water (° DH)} = \text{concentration expressed in terms of } CaCO_3 \text{ (mg/L)} \times 0.05603$$

The detergent liquid for use in the present invention is obtained by mixing, relative to 1 part by mass of component (a), preferably 50 parts by mass or more, more preferably 100 parts by mass or more, and preferably 10,000 parts by mass or less, more preferably 5,000 parts by mass or less of component (b).

The ratio of component (b) to the total amount of water used for preparing the detergent liquid for use in the present invention can be preferably 80% by mass or more, more preferably 90% by mass or more, further preferably 95% by mass or more and more preferably 97% by mass or more, and 100% by mass or less, and further less than 100% by mass.

The detergent liquid for use in the present invention can contain any surfactant other than component (a), as long as the effect of the present invention is not impaired. Such a surfactant other than component (a) can be any of surfactants usually used in pharmaceutical products, quasi-pharmaceutical products, cosmetics, toiletry products, sundries, and the like, and specific examples include an anionic surfactant other than component (a), a nonionic surfactant, an amphoteric surfactant and a cationic surfactant.

The detergent liquid for use in the present invention preferably contains a compound selected from a magnesium-containing inorganic compound and an alkylenediamine compound (where the alkylene group has 2 to 6 carbons), preferably a magnesium-containing inorganic compound, in view of an enhancement in emulsification ability against greasy dirt and an increase in detergency. These compounds have a common effect/mechanism of relatively weakly interacting with at least two molecules of component (a) and any optional anionic surfactant to thereby form a complex to result in an enhancement in an effect necessary for the present invention, namely, surface activity such as an emulsification ability.

Examples of the magnesium-containing inorganic compound include magnesium muriate such as magnesium chloride, magnesium salts such as magnesium sulfate and magnesium nitrate, magnesium hydroxide, and magnesium oxide, and a compound selected from magnesium chloride and magnesium sulfate is more preferable and magnesium chloride is further preferable. The alkylenediamine compound is suitably ethylenediamine, propylenediamine, hexylenediamine or cyclohexanediamine, and more preferably cyclohexanediamine.

In the case where the detergent liquid for use in the present invention contains a compound selected from the magnesium-containing inorganic compound and the alkylenediamine compound, the content of the compound in the detergent liquid is preferably 0.00001% by mass or more, more preferably 0.0001% by mass or more, and preferably 10% by mass or less, more preferably 5% by mass or less. The compound may contain crystal water in some cases, and the content here indicated means the mass from which the mass of such crystal water is excluded.

An inorganic compound other than the magnesium-containing inorganic compound may be used, as an aid, in combination with the compound selected from the magnesium-containing inorganic compound and the alkylenediamine compound (where the alkylene group has 2 to 6 carbons), in the detergent liquid for use in the present invention. Examples of the inorganic compound include sodium chloride, potassium chloride, sodium iodide, potassium iodide, sodium sulfate, potassium sulfate, and alum.

A behavior of foam in washing and in rinsing is very important in the present invention. A surfactant having the effect of increasing foam is used in combination with another surfactant in consideration of foamability/foam durability in washing, in a general research of a detergent composition for a hard article such as tableware. However, care needs to be taken when using such a surfactant having the effect of increasing foam, in the present invention because of having a large effect on defoamability in rinsing. In particular, a surfactant selected from a carbobetaine-type surfactant and an alkanolamide-type surfactant needs to be carefully handled in the present invention. The content of the surfactant selected from a carbobetaine-type surfactant and an alkanolamide-type surfactant in the detergent liquid for use in the present invention is preferably 10% by mass or less, more preferably 5% by mass or less, further preferably 1% by mass or less, furthermore preferably 0.1% by mass or less, furthermore preferably 0.01% by mass or less, furthermore preferably 0% by mass, namely, the surfactant is furthermore preferably not contained.

The detergent liquid for use in the present invention can contain, in addition to the above components, other component(s) for use as general raw materials for a detergent for a hard article, such as a viscosity reducer, a polyhydric alcohol, an organic solvent, a preservative, a reducing agent, an enzyme, and a perfume.

The detergent liquid for use in the present invention can be produced by mixing component (a) and component (b), and further, if necessary, an optional component. The detergent liquid may also be prepared by diluting a concentrated composition containing component (a) and water, with component (b). The water contained in the concentrated composition may have a hardness of less than 5° DH. The concentrated composition may contain an optional component. The amount of the water contained in the concentrated composition is preferably within a range which does not have any effect on the effect exerted due to use of component (b). As one example, the detergent liquid for use in the present invention can be prepared by preparing a concentrated composition containing 10% by mass or more and 50% by mass or less of component (a) and water having a hardness of less than 5° DH, and mixing 500 parts by mass or more and 5000 parts by mass or less of component (b) relative to 1 part by mass of the concentrate composition. The washing method of the present invention may include such a step of preparing the detergent liquid, before the contact step.

The method for washing a hard article of the present invention includes the contact step of bringing a detergent liquid obtained by mixing (a) a potassium internal olefin sulfonate and (b) water having a hardness of 5° DH or more, into contact with the hard article.

The detergent liquid at 30° C. or more is brought into contact with the hard article in at least a part of the contact step, (hereinafter, sometimes referred to as "high-temperature contact"), in the method for washing a hard article of the present invention. The temperature of the detergent liquid in the high-temperature contact is preferably 40° C. or more, more preferably 45° C. or more, further preferably 50° C. or more, and preferably 90° C. or less, more preferably 80° C. or less. The temperature of the detergent liquid in the high-temperature contact may be constant or varied as long as the temperature is 30° C. or more. In the present invention, the high-temperature contact is performed in at least a part of the contact step, thereby exhibiting excellent detergency and rinsability.

In the contact step in the present invention, the detergent liquid is brought into contact with a hard article for preferably 10 seconds or more, more preferably 1 minute or more, and preferably 24 hours or less, more preferably 12 hours or less, in view of detergency and rinsability.

In the high-temperature contact, the detergent liquid at 30° C. or more is brought into contact with a hard article for preferably 10 seconds or more, more preferably 1 minute or more, and preferably 24 hours or less, more preferably 12 hours or less, in view of detergency and rinsability.

In the present invention, the ratio of the period of the high-temperature contact to the total period of the contact step is preferably 1% or more, more preferably 10% or more, further preferably 50% or more. The high-temperature contact may be performed throughout the contact step.

The temperature of the detergent liquid may be varied in the contact step encompassing the high-temperature contact. The variation in temperature of the detergent liquid in the contact step may be in various ways, for example, continuous or intermittent. The variation in temperature of the detergent liquid in the contact step may be any of temperature rise, temperature drop, and a combination thereof. In the present invention, the contact step is preferably initiated by bringing the detergent liquid at 30° C. or more into contact with a hard article. That is, the temperature of the detergent liquid to be first brought into contact with the hard article is preferably 30° C. or more.

In the present invention, the contact step is preferably performed by immersing a hard article in the detergent liquid. The high-temperature contact is also preferably performed by immersing the hard article in the detergent liquid at 30° C. or more.

The viscosity of the detergent liquid for use in the present invention is preferably 1 mPa·s or more, more preferably 5 mPa·s or more, and preferably 100,000 mPa·s or less, more preferably 10,000 mPa·s or less.

The pH pf the detergent liquid for use in the present invention, at a temperature in washing of a hard article, is preferably 4 or more, more preferably 5 or more, and preferably 13 or less, more preferably 11 or less.

The hard article after the contact step can be further washed by hand-washing with the detergent liquid in the present invention or other detergent liquid (hereinafter, collectively referred to as "detergent liquid for washing by hand-washing") in the method for washing a hard article of the present invention. In a specific example of such a method for washing by hand-washing, the hard article is washed by hand-washing with a flexible material to which the detergent liquid for washing by hand-washing is attached, followed by rinsing with water. For example, the hard article is washed by allowing a flexible material such as a sponge impregnated with water to retain the detergent liquid for washing by hand-washing, crumpling the sponge several times by hand for foaming, and scrubbing with the sponge.

The method for washing a hard article of the present invention includes the step of rinsing the hard article after the contact step with water having a hardness of 5° DH or more (hereinafter, sometimes referred to as "rinsing step").

The hardness of the water for use in the rinsing step can be selected from 5° DH or more, further 10° DH or more, and further 15° DH or more. The hardness of the water for use in the rinsing step can also be selected from 30° DH or less, further 27° DH or less, and further 25° DH or less.

The temperature of the water for use in the rinsing step is preferably 30° C. or more, more preferably 40° C. or more, further preferably 50° C. or more, and preferably 90° C. or less, more preferably 80° C. or less.

Such rinsing is performed with the hard article after the contact step being in contact with water having the above hardness, preferably at the above temperature. Rinsing can be, for example, rinsing in standing water, rinsing under running water, or a combination thereof.

The washing method of the present invention is for a hard article. Examples of the material forming the hard article include a material selected from plastic, metal, ceramics, lacquer, wood and glass, and a combination thereof. The hard article suitably includes, as the material, a material selected form plastic and glass in view of remarkably exhibiting the effect of the present invention. The hard article more suitably includes, as the material, plastic in view of a further enhancement in detergency with hard water. Examples of the plastic include polyolefin such as polypropylene and polyethylene, polyester such as polymethacrylate, polycarbonate, ABS, polyethylene terephthalate and polybutylene terephthalate, a melamine resin, a phenol resin, and polyamide. The plastic can include polyolefin, in particular, polypropylene from the viewpoint that the effect of the present invention is remarkably exerted. The plastic may be in the form of a composite with other material, such as FRP. The hard article is preferably glass in view of a further enhancement in detergency at high temperatures. Examples of the hard article include tableware, cooking equipment, a storage container, a bathtub, a toilet bowl, a vehicle, floor, a wall, window glass, a window frame, furniture, and a home appliance. The washing method of the present invention is preferably for a tableware. That is, a preferable embodiment of the present invention relates to a method for washing tableware. Examples of the tableware include tableware including a material selected from plastic, metal, ceramics, lacquer, wood, glass, and a combination thereof.

<Detergent Composition for Hard Article>

In the detergent composition for a hard article of the present invention, a potassium internal olefin sulfonate as component (a) and water having a hardness of 5° DH or more as component (b) are formulated. Preferable embodiments of component (a) and component (b) are the same as those in the method for washing a hard article of the present invention. Examples of the hard article also include those described for the method for washing a hard article of the present invention. The detergent composition for a hard article of the present invention is suitably used in the method for washing a hard article of the present invention. A detergent composition for tableware is a preferable embodiment of the present invention.

In the detergent composition for a hard article of the present invention, component (a) is formulated in an amount of preferably 0.001% by mass or more, more preferably 0.01% by mass or more, further preferably 0.1% by mass or more, and preferably 30% by mass or less, more preferably 20% by mass or less, further preferably 10% by mass or less of the formulated raw materials. The detergent composition for a hard article of the present invention is excellent in stability even when it is a formulation containing component (a) at a high concentration. The detergent composition for a hard article of the present invention can be used, as it is, as a detergent liquid, preferably as a detergent liquid for use in the washing method of the present invention, depending on the amount of component (a) to be formulated.

The viscosity of the detergent composition for a hard article of the present invention is preferably 1 mPa·s or more, more preferably 5 mPa·s or more, and preferably 100,000 mPa·s or less, more preferably 10,000 mPa·s or less.

The pH of the detergent composition for a hard article of the present invention, at 20° C., is preferably 4 or more, more preferably 5 or more, and preferably 13 or less, more preferably 11 or less.

The detergent composition for a hard article of the present invention can contain any optional component described for the detergent liquid for use in the present invention, as long as the effect of the present invention is not impaired. The formulation amount of the compound selected from the magnesium-containing inorganic compound and the alkylenediamine compound is, of the formulated raw materials, preferably 0.00001% by mass or more, more preferably 0.0001% by mass or more, and preferably 10% by mass or less, more preferably 5% by mass or less. The formulation amount of the surfactant selected from a carbobetaine-type surfactant and an alkanolamide-type surfactant is, of the formulated raw materials, preferably 10% by mass or less, more preferably 5% by mass or less, further preferably 1% by mass or less, furthermore preferably 0.1% by mass or less, furthermore preferably 0.01% by mass or less, furthermore preferably 0% by mass namely, the surfactant is furthermore preferably not blended.

The present invention relates to use, as a detergent for a hard article, of a composition in which (a) a potassium internal olefin sulfonate and (b) water having a hardness of 5° DH or more are formulated. To the use, the matters described for the method for washing a hard article and the detergent composition for a hard article of the present invention can be appropriately applied.

The present invention further discloses the following: a method for washing a hard article, a detergent composition for a hard article, and use thereof as a detergent for a hard article. To such aspect, the matters described for the method for washing a hard article, the detergent composition for a hard article, and the use as a detergent for a hard article of the present invention can be mutually appropriately applied.

<1>

A method for washing a hard article, the method including:

a contact step of bringing a detergent liquid obtained by mixing (a) a potassium internal olefin sulfonate [hereinafter, referred to as component (a)] and (b) water having a hardness of 5° DH or more [hereinafter, referred to as component (b)], into contact with the hard article, and a step of rinsing the hard article after the contact step with water having a hardness of 5° DH or more, wherein the detergent liquid at 30° C. or more is brought into contact with the hard article in at least a part of the contact step.

<2>

The method for washing a hard article according to <1>, wherein the hard article is one or more hard articles selected from tableware, cooking equipment, a storage container, a bathtub, a toilet bowl, a vehicle, floor, a wall, window glass, a window frame, furniture, and a home appliance.

<3>

The method for washing a hard article according to <1> or <2>, wherein the hard article is tableware.

<4>

The method for washing a hard article according to <3>, wherein a material of the tableware is a material selected from plastic, metal, ceramics, lacquer, wood and glass, and a combination thereof.

<5>

The method for washing a hard article according to <3> or <4>, wherein a material of the tableware includes a material selected form plastic and glass.

<6>

The method for washing a hard article according to any of <1> to <5>, wherein the detergent liquid at 40° C. or more is brought into contact with the hard article in at least a part of the contact step.

<7>

The method for washing a hard article according to any of <1> to <5>, wherein the detergent liquid at 45° C. or more is brought into contact with the hard article in at least a part of the contact step.

<8>

The method for washing a hard article according to any of <1> to <5>, wherein the detergent liquid at 50° C. or more is brought into contact with the hard article in at least a part of the contact step.

<9>

The method for washing a hard article according to any of <1> to <8>, wherein the detergent liquid at 90° C. or less is brought into contact with the hard article in at least a part of the contact step.

<10>

The method for washing a hard article according to any of <1> to <8>, wherein the detergent liquid at 80° C. or less is brought into contact with the hard article in at least a part of the contact step.

<11>

The method for washing a hard article according to any of <1> to <10>, wherein the ratio of a potassium internal olefin sulfonate (hereinafter, "potassium internal olefin sulfonate" is referred to as "IOS-K") having the sulfonic acid group at position 2 in component (a) is 5% by mass or more and 20% by mass or less.

<12>

The method for washing a hard article according to any of <1> to <11>, wherein a ratio of IOS-K having the sulfonic acid group at position 2 in component (a) is 6% by mass or more.

<13>

The method for washing a hard article according to any of <1> to <12>, wherein a ratio of IOS-K having the sulfonic acid group at position 2 in component (a) is 18% by mass or less.

<14>

The method for washing a hard article according to any of <1> to <13>, wherein a content of IOS-K having the sulfonic acid group at position 1 of a carbon chain (hereinafter, referred to as "component (a')") in component (a) is 20% by mass or less.

<15>

The method for washing a hard article according to any of <1> to <13>, wherein a content of component (a') in component (a) is 10% by mass or less.

<16>

The method for washing a hard article according to any of <1> to <13>, wherein a content of component (a') in component (a) is 5% by mass or less.

<17>

The method for washing a hard article according to any of <1> to <13>, wherein a content of component (a') in component (a) is 3% by mass or less.

<18>

The method for washing a hard article according to any of <1> to <17>, wherein a content of component (a') in component (a) is 0% by mass or more.

<19>

The method for washing a hard article according to any of <1> to <17>, wherein a content of component (a') in component (a) is 0% by mass.

<20>

The method for washing a hard article according to any of <1> to <19>, wherein the detergent liquid contains IOS-K having 16 or more and 18 or less carbons, as (a).

<21>

The method for washing a hard article according to any of <1> to <20>, wherein the detergent liquid contains IOS-K having 18 carbons, as (a).

<22>

The method for washing a hard article according to any of <1> to <21>, wherein a mass ratio of a potassium internal olefin sulfonate having 16 carbons (hereinafter, referred to as "$C_{16}$IOS-K") and a potassium internal olefin sulfonate having 18 carbons (hereinafter, referred to as "$C_{18}$IOS-K") in (a), $C_{16}$IOS-K/$C_{18}$IOS-K, is 0.1 or less.

<23>

The method for washing a hard article according to any of <1> to <21>, wherein a mass ratio of $C_{16}$IOS-K and $C_{18}$IOS-K in component (a), $C_{16}$IOS-K/$C_{18}$IOS-K, is 0.05 or less.

<24>

The method for washing a hard article according to any of <1> to <21>, wherein a mass ratio of $C_{16}$IOS-K and $C_{18}$IOS-K in component (a), $C_{16}$IOS-K/$C_{18}$IOS-K, is 0.01 or less.

<25>

The method for washing a hard article according to any of <1> to <24>, wherein a mass ratio of $C_{16}$IOS-K and $C_{18}$IOS-K in component (a), $C_{16}$IOS-K/$C_{18}$IOS-K, is 0 or more.

<26>

The method for washing a hard article according to any of <1> to <24>, wherein a mass ratio of $C_{16}$IOS-K and $C_{18}$IOS-K in component (a), $C_{16}$IOS-K/$C_{18}$IOS-K, is 0.

<27>

The method for washing a hard article according to any of <1> to <26>, wherein a ratio of a total of $C_{16}$IOS-K and $C_{18}$IOS-K in component (a) is 50% by mass or more.

<28>

The method for washing a hard article according to any of <1> to <26>, wherein a ratio of a total of $C_{16}$IOS-K and $C_{18}$IOS-K in component (a) is 70% by mass or more.

<29>

The method for washing a hard article according to any of <1> to <26>, wherein a ratio of a total of $C_{16}$IOS-K and $C_{18}$IOS-K in component (a) is 80% by mass or more.

<30>

The method for washing a hard article according to any of <1> to <26>, wherein a ratio of a total of $C_{16}$IOS-K and $C_{18}$IOS-K in component (a) is 90% by mass or more.

<31>

The method for washing a hard article according to any of <1> to <26>, wherein a ratio of a total of $C_{16}$IOS-K and $C_{18}$IOS-K in component (a) is 95% by mass or more.

<32>

The method for washing a hard article according to any of <1> to <26>, wherein a ratio of a total of $C_{16}$IOS-K and $C_{18}$IOS-K in component (a) is 97% by mass or more.

<33>

The method for washing a hard article according to any of <1> to <32>, wherein a ratio of a total of $C_{16}$IOS-K and $C_{18}$IOS-K in component (a) is 100% by mass or less.

<34>

The method for washing a hard article according to any of <1> to <32>, wherein a ratio of a total of $C_{16}$IOS-K and $C_{18}$IOS-K in component (a) is 100% by mass.

<35>

The method for washing a hard article according to any of <1> to <34>, wherein the detergent liquid contains 0.001% by mass or more and 30% by mass or less of component (a).

<36>

The method for washing a hard article according to any of <1> to <35>, wherein the detergent liquid contains 0.01% by mass or more of component (a).

<37>

The method for washing a hard article according to any of <1> to <35>, wherein the detergent liquid contains 0.1% by mass or more of component (a).

<38>

The method for washing a hard article according to any of <1> to <37>, wherein the detergent liquid contains 20% by mass or less of component (a).

<39>

The method for washing a hard article according to any of <1> to <37>, wherein the detergent liquid contains 10% by mass or less of component (a).

<40>

The method for washing a hard article according to any of <1> to <39>, wherein the hardness of component (b) is 5° DH or more.

<41>

The method for washing a hard article according to any of <1> to <39>, wherein the hardness of component (b) is 10° DH or more.

<42>

The method for washing a hard article according to any of <1> to <39>, wherein the hardness of component (b) is 15° DH or more.

<43>

The method for washing a hard article according to any of <1> to <42>, wherein the hardness of component (b) is 30° DH or less.

<44>

The method for washing a hard article according to any of <1> to <42>, wherein the hardness of component (b) is 27° DH or less.

<45>

The method for washing a hard article according to any of <1> to <42>, wherein the hardness of component (b) is 25° DH or less.

<46>

The method for washing a hard article according to any of <1> to <45>, wherein a content of a compound selected from a magnesium-containing inorganic compound and an alkylenediamine compound (where the alkylene group has 2 to 6 carbons) in the detergent liquid is 0.00001% by mass or more.

<47>

The method for washing a hard article according to any of <1> to <45>, wherein a content of a compound selected from a magnesium-containing inorganic compound and an alkylenediamine compound (where the alkylene group has 2 to 6 carbons) in the detergent liquid is 0.0001% by mass or more.

<48>

The method for washing a hard article according to any of <1> to <47>, wherein a content of a compound selected from a magnesium-containing inorganic compound and an alkylenediamine compound (where the alkylene group has 2 to 6 carbons) in the detergent liquid is 10% by mass or less.

<49>

The method for washing a hard article according to any of <1> to <47>, wherein a content of a compound selected from a magnesium-containing inorganic compound and an alkylenediamine compound (where the alkylene group has 2 to 6 carbons) in the detergent liquid is 5% by mass or less.

<50>

The method for washing a hard article according to any of <1> to <49>, wherein a content of a surfactant selected from a carbobetaine-type surfactant and an alkanolamide-type surfactant in the detergent liquid is 10% by mass or less.

<51>

The method for washing a hard article according to any of <1> to <49>, wherein a content of a surfactant selected from a carbobetaine-type surfactant and an alkanolamide-type surfactant in the detergent liquid is 5% by mass or less.

<52>

The method for washing a hard article according to any of <1> to <49>, wherein a content of a surfactant selected from a carbobetaine-type surfactant and an alkanolamide-type surfactant in the detergent liquid is 1% by mass or less.

<53>

The method for washing a hard article according to any of <1> to <49>, wherein a content of a surfactant selected from a carbobetaine-type surfactant and an alkanolamide-type surfactant in the detergent liquid is 0.1% by mass or less.

<54>

The method for washing a hard article according to any of <1> to <49>, wherein a content of a surfactant selected from a carbobetaine-type surfactant and an alkanolamide-type surfactant in the detergent liquid is 0.01% by mass or less.

<55>

The method for washing a hard article according to any of <1> to <49>, wherein a content of a surfactant selected from a carbobetaine-type surfactant and an alkanolamide-type surfactant in the detergent liquid is 0% by mass.

<56>

The method for washing a hard article according to any of <1> to <55>, wherein the hard article is immersed in the detergent liquid at 30° C. or more in the contact step.

<57>

The method for washing a hard article according to any of <1> to <56>, wherein the hardness of the water for use in the rinsing step is 5° DH or more.

<58>

The method for washing a hard article according to any of <1> to <56>, wherein the hardness of the water for use in the rinsing step is 10° DH or more.

<59>

The method for washing a hard article according to any of <1> to <56>, wherein the hardness of the water for use in the rinsing step is 15° DH or more.

<60>

The method for washing a hard article according to any of <1> to <59>, wherein the hardness of the water for use in the rinsing step is 30° DH or less.

<61>

The method for washing a hard article according to any of <1> to <59>, wherein the hardness of the water for use in the rinsing step is 27° DH or less.

<62>

The method for washing a hard article according to any of <1> to <59>, wherein the hardness of the water for use in the rinsing step is 25° DH or less.

<63>

The method for washing a hard article according to any of <1> to <62>, wherein a temperature of the water for use in the rinsing step is 30° C. or more.

<64>

The method for washing a hard article according to any of <1> to <62>, wherein a temperature of the water for use in the rinsing step is 40° C. or more.

<65>

The method for washing a hard article according to any of <1> to <62>, wherein a temperature of the water for use in the rinsing step is 50° C. or more.

<66>

The method for washing a hard article according to any of <1> to <65>, wherein a temperature of the water for use in the rinsing step is 90° C. or less.

<67>

The method for washing a hard article according to any of <1> to <65>, wherein a temperature of the water for use in the rinsing step is 80° C. or less.

<68>

The method for washing a hard article according to any of <1> to <67>, wherein the rinsing in the rinsing step is rinsing in standing water or rinsing under running water, or a combination thereof.

<69>

The method for washing a hard article according to any of <1> to <68>, wherein a material of the hard article is a material selected from plastic, metal, ceramics, lacquer, wood and glass, and a combination thereof.

<70>

The method for washing a hard article according to any of <1> to <68>, wherein a material of the hard article includes a material selected form plastic and glass.

<71>

The method for washing a hard article according to any of <1> to <68>, wherein a material of the hard article includes plastic.

<72>

The method for washing a hard article according to any of <69> to <71>, wherein the plastic is plastic selected from polyolefin, polymethacrylate, polycarbonate, ABS, polyester, a melamine resin, a phenol resin, and polyamide.

<73>

The method for washing a hard article according to any of <69> to <71>, wherein the plastic includes polyolefin.

<74>

The method for washing a hard article according to any of <69> to <71>, wherein the plastic includes polypropylene.

<75>

The method for washing a hard article according to any of <1> to <74>, wherein a material of the hard article includes glass.

<76>

A detergent composition for a hard article, wherein (a) IOS-K and (b) water having a hardness of 5° DH or more are formulated.

<77>

The detergent composition for a hard article according to <76>, wherein component (a) is formulated in an amount of 0.001% by mass or more and 30% by mass or less of the formulated raw materials.

<78>

The detergent composition for a hard article according to <76>, wherein component (a) is formulated in an amount of 0.01% by mass or more of the formulated raw materials.

<79>

The detergent composition for a hard article according to <76>, wherein component (a) is formulated in an amount of 0.1% by mass or more of the formulated raw materials.

<80>

The detergent composition for a hard article according to any of <76> to <79>, wherein component (a) is formulated in an amount of 20% by mass or less of the formulated raw materials.

<81>

The detergent composition for a hard article according to any of <76> to <79>, wherein component (a) is formulated in an amount of 10% by mass or less of the formulated raw materials.

<82>

The detergent composition for a hard article according to any of <76> to <81>, for use in the method for washing a hard article according to any one of <1> to <75>.

<83>

The detergent composition for a hard article according to any of <76> to <82>, wherein a formulation amount of a compound selected from a magnesium-containing inorganic compound and an alkylenediamine compound (where the alkylene group has 2 to 6 carbons) is 0.00001% by mass or more of the formulated raw materials.

<84>

The detergent composition for a hard article according to any of <76> to <82>, wherein a formulation amount of a compound selected from a magnesium-containing inorganic compound and an alkylenediamine compound (where the alkylene group has 2 to 6 carbons) is 0.0001% by mass or more of the formulated raw materials.

<85>

The detergent composition for a hard article according to any of <76> to <84>, wherein a formulation amount of a compound selected from a magnesium-containing inorganic compound and an alkylenediamine compound (where the alkylene group has 2 to 6 carbons) is 10% by mass or less of the formulated raw materials.

<86>

The detergent composition for a hard article according to any of <76> to <84>, wherein a formulation amount of a compound selected from a magnesium-containing inorganic compound and an alkylenediamine compound (where the alkylene group has 2 to 6 carbons) is 5% by mass or less of the formulated raw materials.

<87>

The detergent composition for a hard article according to any of <76> to <86>, wherein a formulation amount of a surfactant selected from a carbobetaine-type surfactant and an alkanolamide-type surfactant is 10% by mass or less of the formulated raw materials.

<88>

The detergent composition for a hard article according to any of <76> to <86>, wherein a formulation amount of a surfactant selected from a carbobetaine-type surfactant and an alkanolamide-type surfactant is 5% by mass or less of the formulated raw materials.

<89>

The detergent composition for a hard article according to any of <76> to <86>, wherein a formulation amount of a surfactant selected from a carbobetaine-type surfactant and an alkanolamide-type surfactant is 1% by mass or less of the formulated raw materials.

<90>

The detergent composition for a hard article according to any of <76> to <86>, wherein a formulation amount of a surfactant selected from a carbobetaine-type surfactant and an alkanolamide-type surfactant is 0.1% by mass or less of the formulated raw materials.

<91>

The detergent composition for a hard article according to any of <76> to <86>, wherein a formulation amount of a surfactant selected from a carbobetaine-type surfactant and an alkanolamide-type surfactant is 0.01% by mass or less of the formulated raw materials.

<92>

The detergent composition for a hard article according to any of <76> to <86>, wherein a formulation amount of a surfactant selected from a carbobetaine-type surfactant and an alkanolamide-type surfactant is 0% by mass of the formulated raw materials.

<93>

The detergent composition for a hard article according to any of <76> to <92>, the detergent composition being used as a detergent liquid at 30° C. or more.

<94>

Use, as a detergent for a hard article, of a composition in which (a) IOS-K and (b) water having a hardness of 5° DH or more are formulated.

<95>

Use of a composition in which (a) IOS-K and (b) water having a hardness of 5° DH or more are formulated, as a detergent for a hard article, the detergent being used as a detergent liquid at 30° C. or more.

EXAMPLES

Production Example 1 (Production of Internal Olefin Having 18 Carbons)

A flask equipped with a stirring device was charged with 7000 g (25.9 mol) of 1-octadecanol (product name: Kalcol 8098, manufactured by Kao Corporation) and 700 g of γ-alumina (Strem Chemicals, Inc.) as a solid acid catalyst, and a reaction was performed at 280° C. under stirring while nitrogen was allowed to flow (7000 mL/min) in the reaction system. The reaction time was appropriately adjusted so as to produce internal olefins different in double bond distribution.

Production Example 2 (Production of Potassium Internal Olefin Sulfonate Having 18 Carbons)

Each internal olefin produced in Production Example 1 was placed in a thin-film sulfonation reactor (inner diameter: 14 mmφ, length: 4 m), and a sulfonation reaction was performed using a sulfur trioxide gas having a concentration of $SO_3$ of 2.8% by volume in a condition that cooling water at 20° C. was allowed to flow in an external jacket of the reactor. The reaction molar ratio of $SO_3$/internal olefin was set to 1.09.

The resulting sulfonated product was added to an aqueous alkaline solution which had been prepared by adding potassium hydroxide so as to satisfy an acid value (AV) 1.2 times by mol higher than the theoretical acid value, and the resulting mixture was neutralized with stirring at 30° C. for 1 hour. The neutralized product was heated in an autoclave at 160° C. for 1 hour to thereby perform hydrolysis, thereby producing a crude product of a potassium internal olefin sulfonate having 18 carbons.

300 g of the resulting crude product was transferred to a separatory funnel. 300 mL of ethanol was added thereto, and then 300 mL of petroleum ether per operation was added thereto to remove oil-soluble impurities. At this time, a component such as a salt cake precipitated at the oil-water interface by addition of ethanol was also separated and removed from an aqueous phase by the oil-water separation operation, and the operation was performed three times. The aqueous phase was subjected to evaporation to dryness, thereby providing a potassium internal olefin sulfonate having 18 carbons. This compound is represented by "C18" and "K salt" in the Tables.

Production Example 3 (Production of Sodium Internal Olefin Sulfonate Having 18 Carbons)

The internal olefin produced in Production Example 1 was placed in a thin-film sulfonation reactor (inner diameter: 14 mmφ, length: 4 m), and a sulfonation reaction was performed using a sulfur trioxide gas having a concentration of $SO_3$ of 2.8% by volume in a condition that cooling water at 20° C. was allowed to flow in an external jacket of the reactor. The reaction molar ratio of $SO_3$/internal olefin was set to 1.09.

The resulting sulfonated product was added to an aqueous alkaline solution which had been prepared by adding sodium hydroxide so as to satisfy an acid value (AV) 1.2 times by mol higher than the theoretical acid value, and the resulting mixture was neutralized with stirring at 30° C. for 1 hour. The neutralized product was heated in an autoclave at 160° C. for 1 hour to thereby perform hydrolysis, thereby producing a crude product of a sodium internal olefin sulfonate having 18 carbons.

300 g of the resulting crude product was transferred to a separatory funnel. 300 mL of ethanol was added thereto, and then 300 mL of petroleum ether per operation was added thereto to remove oil-soluble impurities. At this time, a component such as a salt cake precipitated at the oil-water interface by addition of ethanol was also separated and removed from an aqueous phase by the oil-water separation operation, and the operation was performed three times. The aqueous phase was subjected to evaporation to dryness, thereby providing a sodium internal olefin sulfonate having 18 carbons. This compound is represented by "C18" and "Na salt" in the Tables.

Production Example 4 (Production of Internal Olefin Having 16 Carbons)

A flask equipped with a stirring device was charged with 7000 g (28.9 mol) of 1-hexadecanol (product name: Kalcol 6098, manufactured by Kao Corporation) and 700 g of γ-alumina (Strem Chemicals, Inc.) as a solid acid catalyst, and a reaction was performed at 280° C. under stirring while nitrogen was allowed to flow (7000 mL/min) in the reaction system. The reaction time was appropriately adjusted so as to thereby produce internal olefins different in double bond distribution.

Production Example 5 (Production of Potassium Internal Olefin Sulfonate Having 16/18 Carbons)

The internal olefin produced in Production Example 1 and the internal olefin produced in Production Example 3 were mixed at a mass ratio, internal olefin in Production Example 1/internal olefin in Production Example 3, of 80/20, thereby providing an internal olefin having 16/18 carbons. This olefin was placed in a thin-film sulfonation reactor (inner diameter: 14 mmφ, length: 4 m), and a sulfonation reaction was performed using a sulfur trioxide gas having a concentration of $SO_3$ of 2.8% by volume in a condition that cooling water at 20° C. was allowed to flow in an external jacket of the reactor. The reaction molar ratio of $SO_3$/internal olefin was set to 1.09.

The resulting sulfonated product was added to an aqueous alkaline solution which had been prepared by adding potassium hydroxide so as to satisfy an acid value (AV) 1.2 times by mol higher than the theoretical acid value, and the resulting mixture was neutralized with stirring at 30° C. for 1 hour. The neutralized product was heated in an autoclave at 160° C. for 1 hour to thereby perform hydrolysis, thereby producing a crude product of a potassium internal olefin sulfonate having 16/18 carbons.

300 g of the resulting crude product was transferred to a separatory funnel. 300 mL of ethanol was added thereto, and then 300 mL of petroleum ether per operation was added thereto to remove oil-soluble impurities. At this time, a component such as a salt cake precipitated at the oil-water interface by addition of ethanol was also separated and removed from an aqueous phase by the oil-water separation operation, and the operation was performed three times. The aqueous phase was subjected to evaporation to dryness, thereby providing potassium internal olefin sulfonate having 16/18 carbons. The compound is represented by "C16/C18" and "K salt" in the Tables.

(1) Preparation of Concentrated Composition for Detergent Liquid

Each component (a) and ion exchange water, shown in Tables 1 to 3, were used to prepare a concentrated composition for a detergent liquid, the concentrated composition having a content of component (a) of 25% by mass. A compound not corresponding to component (a) was also shown as component (a) in Table 3.

(2) Evaluation (2-1) Evaluation of Detergency

The mass of a glass slide or a polypropylene plate (represented by "PP" in the Tables) was measured (tare mass). The glass slide or polypropylene plate was coated with 0.1 g of beef tallow, and the beef tallow was solidified to provide test piece (1). The mass (mass before washing) of test piece (1) was measured.

One gram of the concentrated composition for a detergent liquid was diluted with 1000 mL of component (b), thereby preparing a detergent liquid.

The detergent liquid and test piece (1) were set in a tester described in "Detergency Evaluation Method of Synthetic Detergent for Kitchen" in JIS K 3362 9.2, and subjected to washing with stirring at each washing temperature in Tables 1 to 3 for 3 minutes. After the washing, test piece (1) was rinsed with water having the hardness in Tables 1 to 3.

After the rinsing, test piece (1) was dried, the mass thereof (mass after washing) was measured and compared with the mass before washing, the amount of beef tallow removed by washing was calculated, and the washing rate was determined by the following formula. The results were shown in Tables 1 to 3.

$$\text{Washing rate (\%)}=\{(\text{Mass before washing})-(\text{Mass after washing})\}/\{(\text{Mass before washing})-(\text{Tare mass})\}\times 100$$

(2-2) Evaluation of Rinsability

One gram of the concentrated composition for a detergent liquid was diluted to 30-fold with water having a hardness in Tables 1 to 3, thereby preparing a detergent liquid.

Thirty grams of the detergent liquid was absorbed in a sponge (Kikulon A manufactured by Kikulon Co., Ltd.) and foamed by crumpling ten times, and 3 g of such foam was added to a measuring cylinder (manufactured by ARROW, 2000 mL: bottom area: 50 $cm^2$).

Water having the hardness at the temperature in Tables 1 to 3 was continuously dropped from above of the measuring cylinder.

The dropping was performed at a total rate of 20 mL/sec using a tool, which was a resin bottle having a bottom area of 7 $cm^2$ and having 19 holes each having a diameter of 1 mm on the bottom.

The state of foam immediately after the dropping was observed. The point of time when foam disappeared to allow the water surface to be seen from above of the measuring cylinder was defined as an endpoint, and the amount of water at the endpoint was recorded. The results were shown in Tables 1 to 3.

TABLE 1

| | | Example | | | | Comparative Example | Example | | Comparative Example |
|---|---|---|---|---|---|---|---|---|---|
| | | 1-1 | 1-2 | 1-3 | 1-4 | 1-1 | 2-1 | 2-2 | 2-1 |
| Component (a) | Number of carbons | C18 | C18 | C18 | C18 | C18 | C18 | C18 | C18 |
| | Salt | K salt | K salt | K salt | K salt | K salt | K salt | K salt | K salt |
| | Percentage of sulfonic acid at position 2 (% by mass) | 16.77 | 16.77 | 16.77 | 16.77 | 16.77 | 16.77 | 16.77 | 16.77 |

TABLE 1-continued

| | | | | | | | | | |
|---|---|---|---|---|---|---|---|---|---|
| Component (b) | Hardness (° DH) | 15 | 15 | 15 | 15 | 15 | 10 | 10 | 10 |
| Hardness of water (Note 1) (° DH) | | 15 | 15 | 15 | 15 | 15 | 10 | 10 | 10 |
| Temperature (Note 2) (° C.) | | 60 | 50 | 40 | 30 | 25 | 50 | 40 | 25 |
| Washing rate (glass) (%) | | 82.0 | 83.8 | 51.2 | 47.5 | 11.2 | 77.0 | 48.0 | 10.9 |
| Washing rate (PP) (%) | | 65.0 | 63.5 | 45.6 | 33.1 | 5.4 | 59.4 | 30.7 | 2.5 |
| Rinsability (mL) | | 350 | 400 | 500 | 500 | 750 | 500 | 725 | 800 |

| | | Example | | | Comparative Example | | | Comparative Example | | |
|---|---|---|---|---|---|---|---|---|---|---|
| | | 3-1 | 3-2 | 3-3 | 3-1 | 3-2 | 3-3 | 4-1 | 4-2 | 4-3 |
| Component (a) | Number of carbons | C18 | C18 | C18 | C18 | C18 | C18 | C18 | C18 | C18 |
| | Salt | K salt | K salt | K salt | K salt | K salt | K salt | K salt | K salt | K salt |
| | Percentage of sulfonic acid at position 2 (% by mass) | 16.77 | 16.77 | 16.77 | 16.77 | 16.77 | 16.77 | 16.77 | 16.77 | 16.77 |
| Component (b) | Hardness (° DH) | 5 | 5 | 5 | 3 | 3 | 3 | 0 | 0 | 0 |
| Hardness of water (Note 1) (° DH) | | 5 | 5 | 5 | 3 | 3 | 3 | 0 | 0 | 0 |
| Temperature (Note 2) (° C.) | | 50 | 40 | 30 | 50 | 40 | 30 | 50 | 40 | 25 |
| Washing rate (glass) (%) | | 69.6 | 46.3 | 38.3 | 59.4 | 36.4 | 28.1 | 75.6 | 44.1 | 2.4 |
| Washing rate (PP) (%) | | 59.1 | 30.3 | 23.1 | 30.5 | 22.8 | 19.1 | 29.0 | 28.9 | 1.8 |
| Rinsability (mL) | | 550 | 575 | 575 | 800 | 950 | 1000 | 1150 | 1150 | 1250 |

TABLE 2

| | | Example | | Example | Example | Example | Comparative Example |
|---|---|---|---|---|---|---|---|
| | | 4-1 | 4-2 | 5-1 | 1-2 | 2-1 | 4-1 |
| Component (a) | Number of carbons | C18 | C18 | C16/C18 | C18 | C18 | C18 |
| | Salt | K | K | K | K | K | K |
| | Percentage of sulfonic acid at position 2 (% by mass) | 16.77 | 4.98 | 16.77 | 16.77 | 16.77 | 16.77 |
| Component (b) | Hardness (° DH) | 20 | 15 | 15 | 15 | 10 | 0 |
| Hardness of water (Note 1) (° DH) | | 20 | 15 | 15 | 15 | 10 | 0 |
| Temperature (Note 2) (° C.) | | 50 | 50 | 50 | 50 | 50 | 50 |
| Washing rate (glass) (%) | | 84 | 65 | 75 | 83.8 | 77 | 75.6 |
| Washing rate (PP) (%) | | 64 | 44.1 | 50 | 63.5 | 59.4 | 29 |
| Rinsability (mL) | | 400 | 400 | 600 | 400 | 500 | 1150 |

TABLE 3

| | | Example | | | Comparative Example | | |
|---|---|---|---|---|---|---|---|
| | | 1-2 | 1-3 | 1-4 | 5-1 | 5-2 | 5-3 |
| Component (a) | Number of carbons | C18 | C18 | C18 | C18 | C18 | C18 |
| | Salt | K salt | K salt | K salt | Na salt | Na salt | Na salt |
| | Percentage of sulfonic acid at position 2 (% by mass) | 16.77 | 16.77 | 16.77 | 16.77 | 16.77 | 16.77 |
| Component (b) | Hardness(° DH) | 15 | 15 | 15 | 15 | 15 | 15 |
| Hardness of water (Note 1) (° DH) | | 15 | 15 | 15 | 15 | 15 | 15 |
| Temperature (Note 2) (° C.) | | 50 | 40 | 30 | 50 | 40 | 30 |
| Washing rate (glass) (%) | | 83.8 | 51.2 | 47.5 | 60.3 | 44.1 | 40.3 |
| Washing rate (PP) (%) | | 63.5 | 45.6 | 33.1 | 22.1 | 19.3 | 16.5 |
| Rinsability (mL) | | 400 | 500 | 500 | 500 | 550 | 600 |

(Note 1) Hardness of water: hardness of water used in preparation of detergent liquid and evaluation of rinsability (Note 2) Temperature: temperature of water used in evaluation of temperature or rinsability in washing In the Tables, C18 means that the number of carbons in component (a) is 18.

In the Tables, the "Percentage of sulfonic acid at position 2" of component (a) means the ratio of IOS-K or IOS-Na having the sulfonic acid group at position 2 in component (a).

In the Tables, water having a hardness not corresponding to the hardness of component (b) is also shown in the column of component (b), for convenience.

Tables 2 and 3 again present Examples and Comparative Examples presented in a part of Table 1.

The invention claimed is:

1. A method for washing a hard article, the method comprising:

1) bringing a detergent liquid comprising (a) a potassium internal olefin sulfonate and (b) water having a hardness of 5° DH or more, into contact with the hard article for a period of time, and 2) rinsing the hard article after said period of time with water having a hardness of 5° DH or more, wherein the detergent liquid has a temperature of 30° C. or more for at least a part of the period of time.

2. The method for washing a hard article according to claim 1, wherein bringing the detergent liquid into contact with the hard article comprises immersing the hard article in the detergent liquid at a temperature of 30° C.

3. The method for washing a hard article according to claim 1, wherein the hard article comprises at least one selected from the group consisting of plastic, metal, ceramics, lacquer, wood, and glass.

4. The method for washing a hard article according to claim 1, wherein the hard article comprises plastic.

5. The method for washing a hard article according to claim 1, wherein the hard article comprises glass.

6. The method for washing a hard article according to claim 1, wherein the potassium internal olefin sulfonate comprises a potassium internal olefin sulfonate having a sulfonic acid group at position 2 in an amount of 5% by mass to 20% by mass.

7. The method for washing a hard article according to claim 1, wherein:

a content of a compound selected from a magnesium-containing inorganic compound and an alkylenediamine compound in the detergent liquid is 10% by mass or less; and the alkylene group of the alkylene diamine has 2 to 6 carbons.

8. The method for washing a hard article according to claim 1, wherein a content of a surfactant selected from a carbobetaine surfactant and an alkanolamide surfactant in the detergent liquid is 10% by mass or less.

9. The method for washing a hard article according to claim 1, wherein the detergent liquid has a temperature of 40° C. or more for at least a part of the period of time.

10. The method for washing a hard article according to claim 1, wherein rinsing is the hard article comprises rinsing with water having a hardness of 5° DH or more and 30° DH or less.

11. The method for washing a hard article according to claim 1, wherein the hard article is tableware.

12. The method for washing a hard article according to claim 1, wherein the potassium internal olefin sulfonate comprises a potassium internal olefin sulfonate having 16 to 18 carbons.

13. The method for washing a hard article according to claim 1, wherein the potassium internal olefin sulfonate comprises (i) a potassium internal olefin sulfonate having 16 carbons and (ii) a potassium internal olefin sulfonate having 18 carbons in a mass ratio, (i):(ii), of 0.1 or less.

14. The method for washing a hard article according to claim 1, wherein the detergent liquid comprises the potassium internal olefin sulfonate in an amount of 0.001% by mass to 30% by mass.

* * * * *